US009555651B2

(12) United States Patent
Wakana

(10) Patent No.: US 9,555,651 B2
(45) Date of Patent: Jan. 31, 2017

(54) METHOD OF CONTROLLING DISCHARGE OF PRINTED SHEETS AS SHEET BUNDLE, SHEET DISCHARGE CONTROL APPARATUS, AND STORAGE MEDIUM

(71) Applicant: CANON KABUSHIKI KAISHA, Tokyo (JP)

(72) Inventor: Toru Wakana, Nagreyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/091,797

(22) Filed: Apr. 6, 2016

(65) Prior Publication Data

US 2016/0297214 A1 Oct. 13, 2016

(30) Foreign Application Priority Data

Apr. 10, 2015 (JP) ..... 2015-080940

(51) Int. Cl.
*B41J 29/393* (2006.01)
*B41J 13/00* (2006.01)

(52) U.S. Cl.
CPC ..... *B41J 13/0009* (2013.01)

(58) Field of Classification Search
CPC ..... B41J 13/0009; B41J 2/01; B41J 11/0015; B41J 2/2114; B41J 2/17566; B41J 2002/17569; B41J 11/42; B41J 19/205
See application file for complete search history.

(56) References Cited

U.S. PATENT DOCUMENTS 8,514,449 B2 * 8/2013 Tanaka ..... H04N 1/603 347/19
8,914,852 B2 * 12/2014 Itogawa ..... G06F 21/34 726/4
8,985,580 B2 3/2015 Ozaki
9,333,782 B1 * 5/2016 Hashimoto ..... H04N 1/40006

FOREIGN PATENT DOCUMENTS

JP 2010277339 A 12/2010

* cited by examiner

*Primary Examiner* — Lamson Nguyen
(74) *Attorney, Agent, or Firm* — Rossi, Kimms & McDowell LLP

(57) ABSTRACT

A method of controlling discharge of printed sheets, which makes it possible to acquire a desired number of printed sheets as a sheet bundle. A controller determines whether or not printed sheets are stored in the stacker. The controller detects the number of printed sheets stored in the stacker. A controller causes the stored printed sheets to be discharged from the stacker as a sheet bundle when the number of printed sheets stored in the stacker is equal to a desired sheet count set by a user. In a case where the set desired sheet count has been changed, if it is determined that the printed sheets are stored in the stacker, the controller causes the printed sheets stored in the sheet discharge unit to be discharged from the stacker.

7 Claims, 10 Drawing Sheets

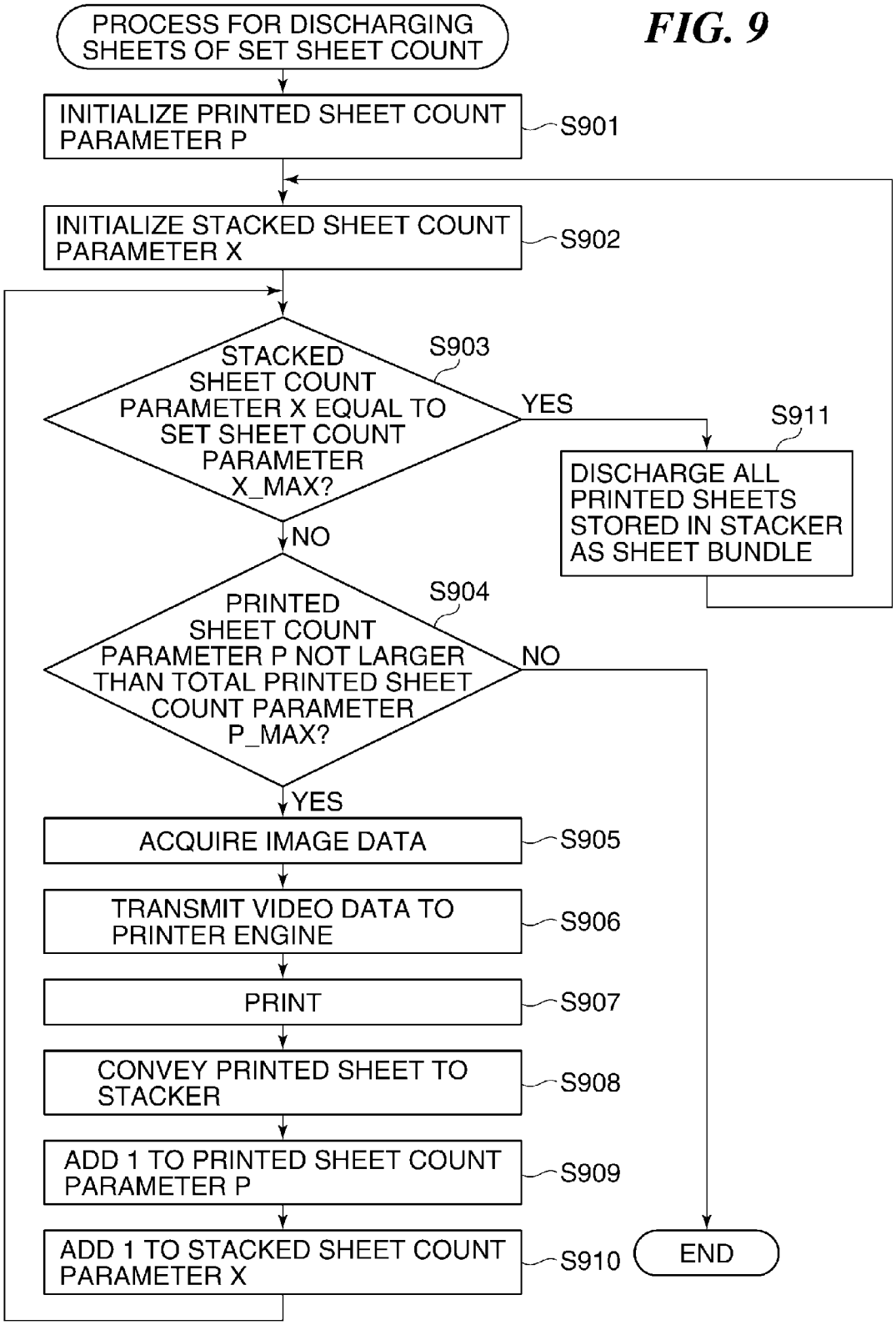
FIG. 9
PROCESS FOR DISCHARGING SHEETS OF SET SHEET COUNT
INITIALIZE PRINTED SHEET COUNT PARAMETER P
S901
INITIALIZE STACKED SHEET COUNT PARAMETER X
S902
STACKED SHEET COUNT PARAMETER X EQUAL TO SET SHEET COUNT PARAMETER X_MAX?
S903
YES
S911
DISCHARGE ALL PRINTED SHEETS STORED IN STACKER AS SHEET BUNDLE
NO
PRINTED SHEET COUNT PARAMETER P NOT LARGER THAN TOTAL PRINTED SHEET COUNT PARAMETER P_MAX?
S904
NO
YES
ACQUIRE IMAGE DATA
S905
TRANSMIT VIDEO DATA TO PRINTER ENGINE
S906
PRINT
S907
CONVEY PRINTED SHEET TO STACKER
S908
ADD 1 TO PRINTED SHEET COUNT PARAMETER P
S909
ADD 1 TO STACKED SHEET COUNT PARAMETER X
S910
END

METHOD OF CONTROLLING DISCHARGE OF PRINTED SHEETS AS SHEET BUNDLE, SHEET DISCHARGE CONTROL APPARATUS, AND STORAGE MEDIUM

BACKGROUND OF THE INVENTION

Field of the Invention

The present invention relates to a method of controlling discharge of printed sheets as a sheet bundle, a sheet discharge control apparatus, and a storage medium, and more particularly to a method of controlling discharge of a set desired number of printed sheets as a sheet bundle, a sheet discharge control apparatus, and a storage medium.

Description of the Related Art

There has been known a sheet discharge control system that conveys a plurality of printed sheets, which have been printed by an MFP as a sheet discharge control apparatus, from the MFP to a stacker apparatus as a sheet discharge unit, and stores the conveyed sheets in the stacker apparatus. In this sheet discharge control system, the MFP performs print processing on the number of sheets to be printed, which is set by a user, and conveys the set number of printed sheets to the stacker apparatus, wherein the conveyed printed sheets are stored. Here, a technique for acquiring printed sheets conveyed from the MFP to the stacker apparatus as a bundle of sheets of a desired sheet count has been proposed e.g. in Japanese Patent Laid-Open Publication No. 2010-277339. In the technique disclosed in Japanese Patent Laid-Open Publication No. 2010-277339, the MFP divides print processing to be performed on the total number of sheets to be printed, based on the desired sheet count which is set by the user, and whenever execution of each divided print processing operation is completed, the stacker apparatus discharges the printed sheets of the desired sheet count as a sheet bundle. This enables the user to acquire the printed sheets of the desired sheet count as a sheet bundle.

However, in the sheet discharge control system described above, there is a case where the user cannot acquire the printed sheets of the desired sheet count as a sheet bundle. For example, if the number of printed sheets stored in the stacker apparatus does not reach the desired sheet count of printed sheets for a print processing operation, the printed sheets stored in the stacker apparatus remains in the stacker apparatus without being discharged from the stacker apparatus. However, thereafter in this state, if a new print processing operation is executed based on the setting of another desired sheet count which is set by the user, this brings about a situation in which two types of printed sheets, which have been printed by two print processing operations different from each other, are mixed in the stacker apparatus. As a result, in either of the two print processing operations, the user cannot acquire the printed sheets of a desired sheet count as a sheet bundle.

SUMMARY OF THE INVENTION

The present invention provides a method of controlling discharge of printed sheets, which makes it possible to acquire printed sheets of a desired sheet count as a sheet bundle, a sheet discharge control apparatus, and a storage medium.

In a first aspect of the present invention, there is provided a method of controlling discharge of printed sheets, which is applied in performing printing, based on a print job including print processing on sheets of a desired sheet count set by a user, on a plurality of sheets, by a printing apparatus, conveying the plurality of sheets on which the printing has been performed from the printing apparatus to a sheet discharge unit, and storing the printed sheets in the sheet discharge unit, the method comprising determining whether or not printed sheets are stored in the sheet discharge unit, detecting the number of printed sheets stored in the sheet discharge unit, and discharging the stored printed sheets from the sheet discharge unit as a sheet bundle when the number of printed sheets stored in the sheet discharge unit is equal to the desired sheet count, wherein said discharging includes discharging the printed sheets stored in the sheet discharge unit from the sheet discharge unit, when it is determined, in a case where the set desired sheet count has been changed, that the printed sheets are stored in the sheet discharge unit.

In a second aspect of the present invention, there is provided a sheet discharge control apparatus that performs control of discharge of printed sheets from a sheet discharge unit, in performing printing, based on a print job including print processing on sheets of a desired sheet count set by a user, on a plurality of sheets, by a printing apparatus, conveying the plurality of sheets on which the printing has been performed from the printing apparatus to the sheet discharge unit, and storing the printed sheets in the sheet discharge unit, the sheet discharge control apparatus comprising a determination unit configured to determine whether or not printed sheets are stored in the sheet discharge unit, a sheet count detection unit configured to detect the number of printed sheets stored in the sheet discharge unit, and a sheet discharge control unit configured to discharge the stored printed sheets from the sheet discharge unit as a sheet bundle when the number of printed sheets stored in the sheet discharge unit is equal to the desired sheet count, wherein the sheet discharge control unit discharges the printed sheets stored in the sheet discharge unit from the sheet discharge unit, when it is determined, in a case where the set desired sheet count has been changed, that the printed sheets are stored in the sheet discharge unit.

In a third aspect of the present invention, there is provided a non-transitory computer-readable storage medium storing a computer-executable control program for causing a computer to execute a method of controlling discharge of printed sheets, which is applied in performing printing, based on a print job including print processing on sheets of a desired sheet count set by a user, on a plurality of sheets, by a printing apparatus, conveying the plurality of sheets on which the printing has been performed from the printing apparatus to a sheet discharge unit, and storing the printed sheets in the sheet discharge unit, wherein the method comprises determining whether or not printed sheets are stored in the sheet discharge unit, detecting the number of printed sheets stored in the sheet discharge unit, and discharging the stored printed sheets from the sheet discharge unit as a sheet bundle when the number of printed sheets stored in the sheet discharge unit is equal to the desired sheet count, wherein said discharging includes discharging the printed sheets stored in the sheet discharge unit from the sheet discharge unit, when it is determined, in a case where the set desired sheet count has been changed, that the printed sheets are stored in the sheet discharge unit.

According to the present invention, it is possible to acquire printed sheets of a desired sheet count as a sheet bundle.

Further features of the present invention will become apparent from the following description of exemplary embodiments (with reference to the attached drawings).

BRIEF DESCRIPTION OF THE DRAWINGS

FIG. 9 is a flowchart of a process for discharging sheets of a set sheet count, which is performed in a step in FIG. 8.

DESCRIPTION OF THE EMBODIMENTS

The present invention will now be described in detail below with reference to the accompanying drawings showing embodiments thereof.

In the present embodiment, although a description will be given of a case where the present invention is applied to an MFP as a sheet discharge control apparatus, this is not limitative, but the present invention can be applied to various apparatuses, insofar as it is an apparatus that is capable of controlling discharge of sheets from a sheet discharge unit.

Figure 1:
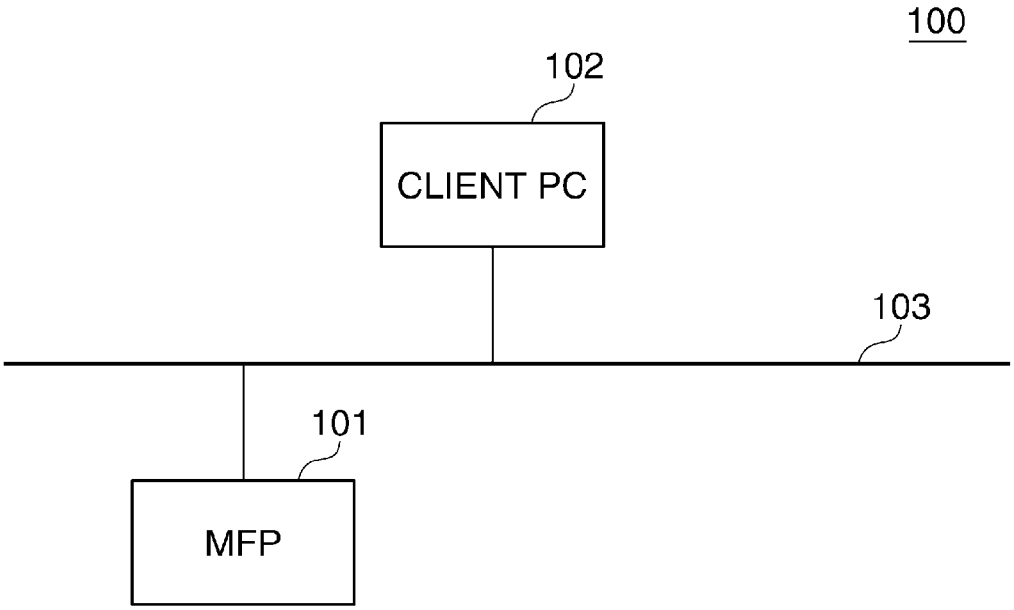
FIG. 1 is a schematic block diagram of a communication system including an MFP as a sheet discharge control apparatus according to an embodiment of the present invention.

FIG. 1 is a schematic block diagram of a communication system 100 including the MFP, denoted by reference numeral 101, as the sheet discharge control apparatus according to an embodiment of the present invention.

Referring to FIG. 1, the communication system 100 includes the MFP 101 and a client PC 102. In the communication system 100, the MFP 101 and the client PC 102 perform data communication with each other via a LAN 103. In the present embodiment, the client PC 102 transmits print data for performing a print job including print processing and sheet discharge processing to the MFP 101, and the MFP 101 performs the print job based on the received print data.

Figure 2:
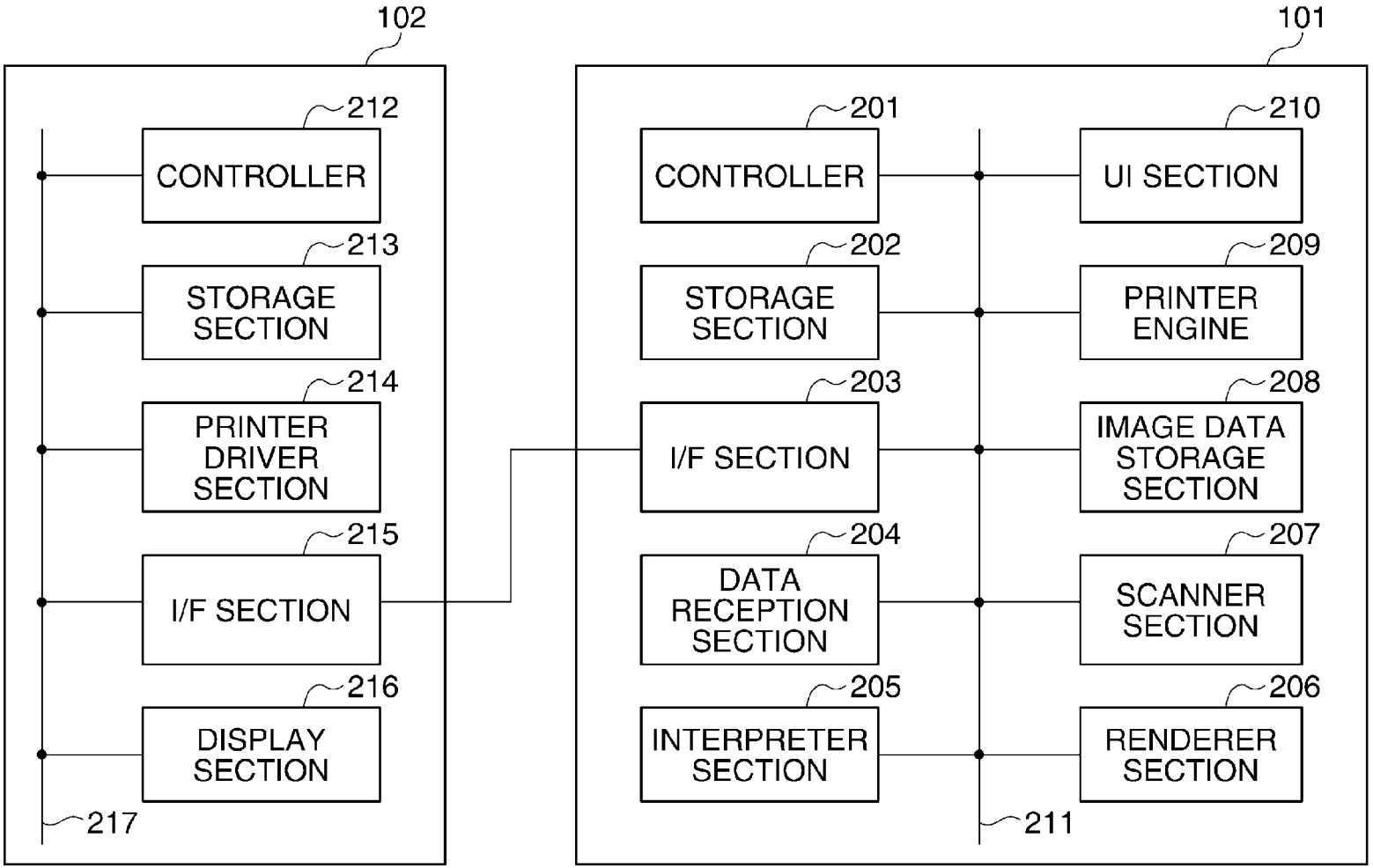
FIG. 2 is a schematic block diagram of the MFP and a client PC, appearing in FIG. 1.

FIG. 2 is a schematic block diagram of the MFP 101 and the client PC 102, appearing in FIG. 1.

Referring to FIG. 2, the MFP 101 includes a controller 201, a storage section 202, an interface section 203, a data reception section 204, an interpreter section 205, a renderer section 206, a scanner section 207, an image data storage section 208, a printer engine 209, and a UI section 210. These components are interconnected via a system bus 211. The client PC 102 includes a controller 212, a storage section 213, a printer driver section 214, an interface section 215, and a display section 216, and these components are interconnected via a system bus 217.

The controller 201 controls the components connected via the system bus 211 by executing various control programs stored in the storage section 202. The storage section 202 stores the various control programs executed by the controller 201 and various data. The interface section 203 performs data communication with the interface section 215 of the client PC 102. In the present embodiment, the interface section 203 acquires print data for performing a print job from the interface section 215. The print data includes data of PDL (Page Description Language), such as PS (PostScript), PCL (Printer Control Language), or LIPS (LBP Image Processing System). The data reception section 204 transmits the print data acquired by the interface section 203 to the storage section 202 or the interpreter section 205. The interpreter section 205 analyzes the received print data, and converts the print data to intermediate data of a format which can be read by the renderer section 206. The renderer section 206 generates image data which can be read by the printer engine 209 based on the intermediate data converted from the print data by the interpreter section 205. The scanner section 207 reads an original set on an original platen glass, not shown, to thereby acquire image information, and generates image data which can be read by the printer engine 209 based on the acquired image information. The image data storage section 208 stores the image data generated by the renderer section 206 or the scanner section 207. The printer engine 209 performs a print job based on the stored image data. The UI section 210 is a user interface, and various settings are made by a user's operation of the UI section 210. In the present embodiment, various setting information, described hereinafter, included in the print data can be changed by a user's operation of the UI section 210.

The controller 212 of the client PC 102 controls the components connected via the system bus 217 by executing various control programs stored in the storage section 213. The storage section 213 stores the various control programs executed by the controller 212 and various setting information set by the user. The printer driver section 214 generates execution data for causing the MFP 101 to execute various processing. In the present embodiment, the printer driver section 214 generates print data based on the various setting information stored in the storage section 213. The interface section 215 performs data communication with the interface section 203. The display section 216 displays setting screens for setting various setting information. In the present embodiment, the display section 216 displays a print setting menu 300 shown in FIG. 3 and a sheet discharge-setting menu 400 shown in FIG. 4, as the setting screens for making various settings of the print data.

Figure 3:
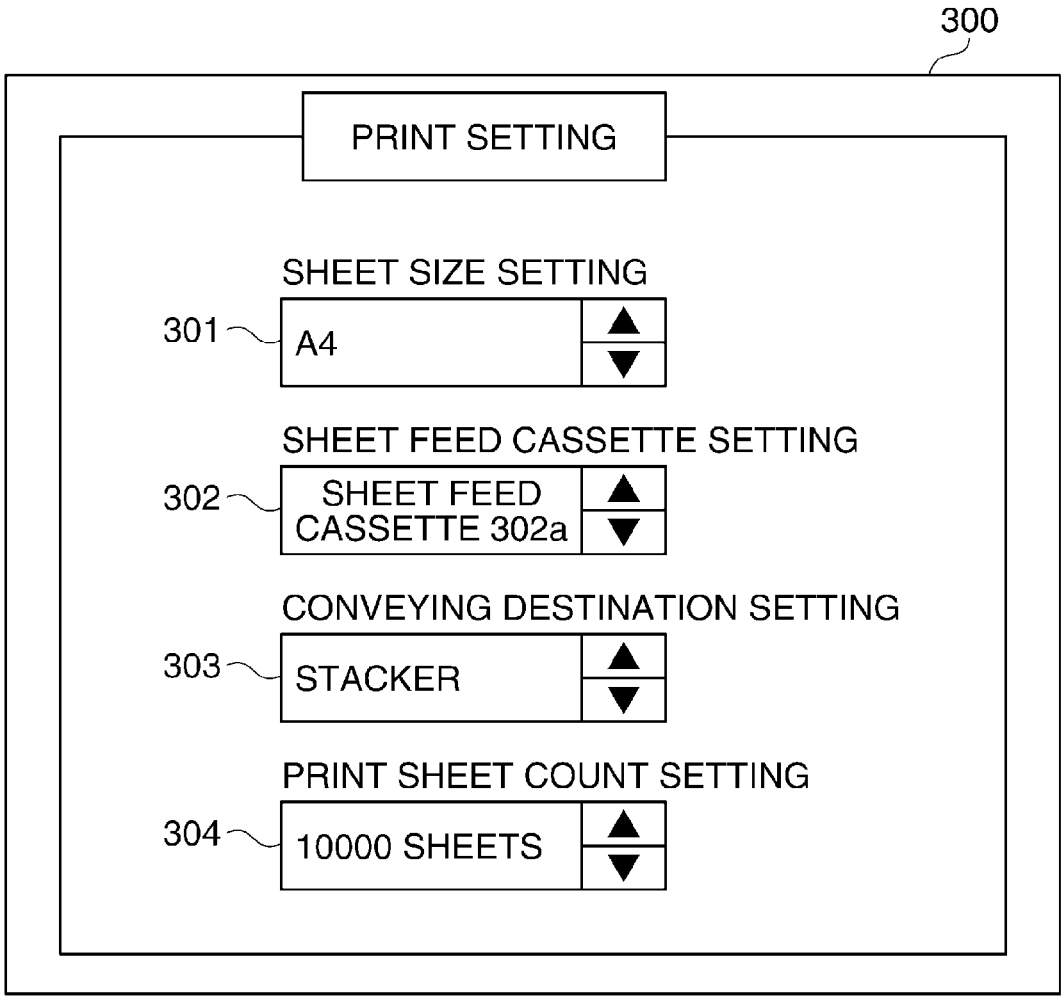
FIG. 3 is a diagram useful in explaining a print setting menu displayed on the client PC.

The print setting menu 300 shown in FIG. 3 includes sheet size setting 301 for setting the size of sheets to be printed, sheet feed cassette setting 302 for setting a sheet feed cassette from which the sheets to be printed are fed, conveying destination setting 303 for setting a destination to which printed sheets are conveyed from the MFP 101, and print sheet count setting 304 for setting the number of sheets to be printed. Further, the sheet discharge-setting menu 400 shown in FIG. 4 includes sheet count setting 401 for setting the number of sheets which are to be discharged as a sheet bundle from a stacker apparatus 501 described hereinafter with reference to FIG. 5. Information on settings of the items of the print setting menu 300 and the sheet discharge-setting menu 400 is stored in the storage section 213.

Figure 5:
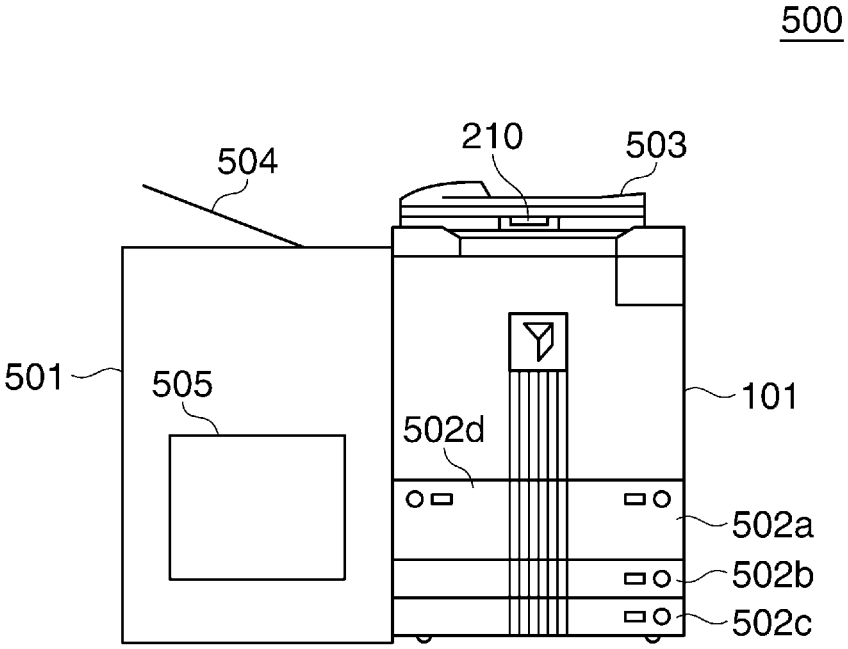
FIG. 5 is a schematic side view of a sheet discharge control system including the MFP.

FIG. 5 is a schematic side view of a including the MFP 101 shown in FIG. 1. Note that in FIG. 5, part of the sheet discharge control system 500 is drawn in a transparent manner to show the internal components for ease of understanding.

Referring to FIG. 5, the sheet discharge control system 500 includes the MFP 101 and the stacker apparatus 501 as the sheet discharge unit, and the MFP 101 is connected to the stacker apparatus 501 such that printed sheets can be conveyed into the stacker apparatus 501. The MFP 101 includes, in addition to the UI section 210 appearing in FIG. 2, sheet feed cassettes 502*a* to 502*d* and an original reading section 503. The stacker apparatus 501 includes a tray 504 and a stacker 505.

The sheet feed cassettes 502*a* to 502*d* each store sheets for printing. The original reading section 503 reads an original set on the original platen glass, not shown, to thereby acquire image information. The stacker apparatus 501 performs sheet discharge processing for printed sheets conveyed from the MFP 101. In the present embodiment, when the stacker apparatus 501 performs a sheet bundle discharge process, described hereinafter, if the number of printed sheets conveyed from the MFP 101 reaches a sheet count to which the sheet count setting 401 is set (hereinafter referred to as the "discharged sheets-setting count") (desired sheet count), the stacker apparatus 501 discharges the printed sheets as a sheet bundle formed by printed sheets of the discharged sheets-setting count. The tray 504 receives printed sheets discharged from the MFP 101 one by one. The stacker 505 stores the printed sheets conveyed from the MFP 101. In the present embodiment, the printed sheets conveyed from the MFP 101 are stored in the stacker 505 until the number of printed sheets conveyed from the MFP 101 reaches the discharged sheets-setting count.

FIGS. 6A to 6F are diagrams useful in explaining a sequence of steps of the sheet bundle discharge process performed by the stacker apparatus 501 appearing in FIG. 5.

The stacker apparatus 501 includes a lift table 601, an eject table 602, a sheet count sensor 603, and a sheet sensor 604, which are provided in the stacker 505. The lift table 601 is provided in a manner capable of lifting and lowering, and the eject table 602 is provided in a horizontally ejectable manner. Printed sheets conveyed from the MFP 101 are stacked on the lift table 601. The eject table 602 is horizontally ejected to thereby discharge a sheet bundle formed by the stacked printed sheets from the stacker apparatus 501. The sheet count sensor 603 is provided at a location from which it can sense printed sheets stacked on the lift table 601, and detects the number of printed sheets stacked on the lift table 601. The sheet sensor 604 is provided at a location from which it can sense printed sheets stacked on the eject table 602, and detects whether or not any printed sheets are stacked on the eject table 602.

First, the stacker apparatus 501 stacks printed sheets conveyed from the MFP 101 on the lift table 601 (see FIG. 6A), and the sheet count sensor 603 detects the number of printed sheets stacked on the lift table 601. Then, when the number of printed sheets stacked on the lift table 601 becomes equal to the discharged sheets-setting count, the stacker apparatus 501 lowers the lift table 601 to thereby move the printed sheets stacked on the lift table 601 to the eject table 602, and returns the lift table 601 to the original position (see FIG. 6B). Then, the stacker apparatus 501 ejects the eject table 602 to thereby discharge the printed sheets stacked on the eject table 602 as a sheet bundle formed by the printed sheets of the discharged sheets-setting count (see FIG. 6C). After that, whenever a printed sheet is conveyed from the MFP 101, the stacker apparatus 501 stacks the printed sheet conveyed from the MFP 101 on the lift table 601 (see FIG. 6D). Then, when the sheet sensor 604 detects that the printed sheets stacked on the eject table 602 have been removed (see FIG. 6E), the stacker apparatus 501 returns the eject table 602 to the original position. After that, when the number of printed sheets stacked on the lift table 601 becomes equal to the discharged sheets-setting count, the stacker apparatus 501 lowers the lift table 601 to thereby move the printed sheets stacked on the lift table 601 to the eject table 602 (see FIG. 6F). If printed sheets continue to be conveyed from the MFP 101 thereafter, the stacker apparatus 501 repeatedly executes the steps from FIG. 6C to FIG. 6F.

Figure 7:
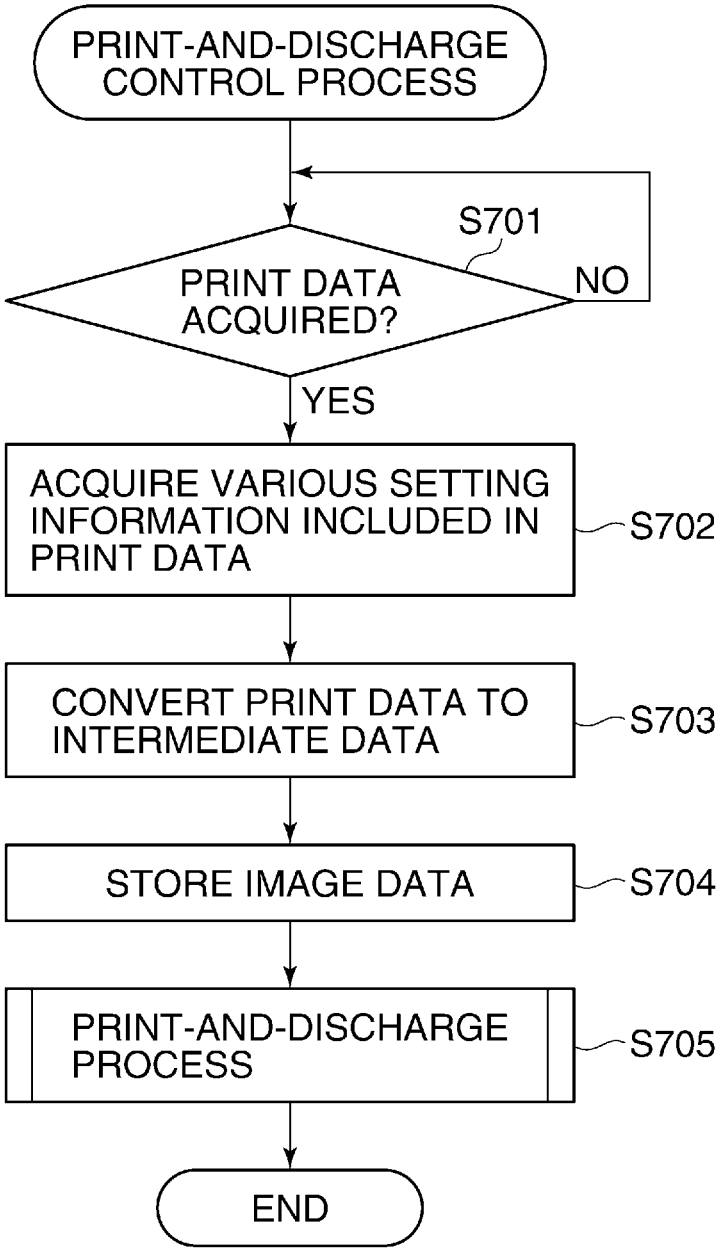
FIG. 7 is a flowchart of a print-and-discharge control process performed by the sheet discharge control system shown in FIG. 5.

FIG. 7 is a flowchart of a print-and-discharge control process performed by the sheet discharge control system 500 shown in FIG. 5.

The print-and-discharge control process in FIG. 7 is performed by the controller 201 that executes the various control programs stored in the storage section 202. Although in the print-and-discharge control process shown in FIG. 7, it is possible to envisage a case where the controller 201 performs print processing using print data generated based on various settings made by operating the UI section 210 of the MFP 101, the following description is given of a case where print data transmitted from the client PC 102 is used, by way of example.

Referring to FIG. 7, first, the controller 201 determines whether or not print data has been acquired from the client PC 102 via the interface section 203 (step S701). It is assumed here that the client PC 102 generates print data based on the settings made on the print setting menu 300 shown in FIG. 3 and the settings made on the sheet discharge-setting menu 400 shown in FIG. 4. The print data in the present embodiment includes the setting information of the sheet size setting 301, the setting information of the sheet feed cassette setting 302, the setting information of the conveying destination setting 303, the setting information of the print sheet count setting 304, and the setting information of the sheet count setting 401 (sheet discharge setting information), and further, includes user identification information for identifying a user who has set the above-mentioned various setting information. If the print data has been acquired from the client PC 102 via the interface section 203 (YES to the step S701), the controller 201 analyzes the acquired print data, and acquires the various setting information included in the print data (step S702). Then, the controller 201 causes the interpreter section 205 to convert the acquired print data to intermediate data of a format which can be read by the renderer section 206 (step S703). Then, the controller 201 cause the renderer section 206 to generate image data based on the intermediate data, and stores the generated image data in the image data storage section 208 (step S704). Then, the controller 201 performs a print-and-discharge process in FIG. 8, described hereinafter, to thereby perform printing on a plurality of sheets based on the print data, and causes the printed sheets to be discharged from the stacker apparatus 501 (step S705), followed by terminating the present process.

Figure 8:
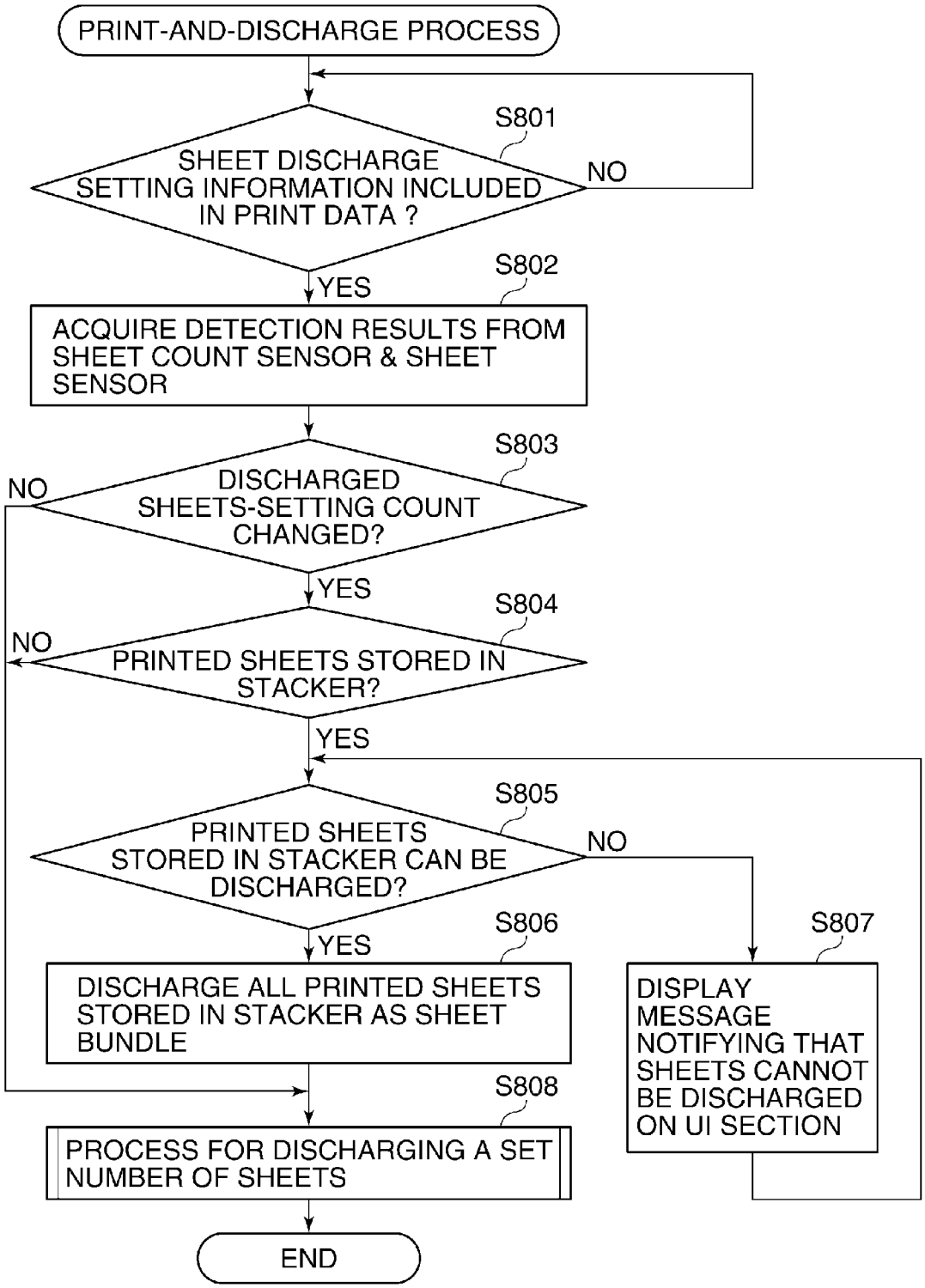
FIG. 8 is a flowchart of a print-and-discharge process performed in a step in FIG. 7.

FIG. 8 is a flowchart of the print-and-discharge process performed in the step S705 in FIG. 7.

In the present example, if the number of printed sheets stored in the stacker 505 has not reached the discharged sheets-setting count during the printing operation executed based on the acquired print data, the printed sheets stored in the stacker 505 remain in the stacker 505 without being discharged therefrom, but after that, if the various setting information of the print data, i.e. the discharged sheets-setting count is changed by a user's operation of the UI section 210, and a new printing operation based on the print data in which the discharged sheets-setting count has been changed (hereinafter referred to as the "setting-changed print data") is performed, this causes a situation where the two types of printed sheets, which have been printed based on the two different print data items, are mixed in the stacker 505. As a result, it is impossible to acquire, from neither of the two print operations, a sheet bundle of printed sheets of the discharged sheets-setting count.

Figure 6A:
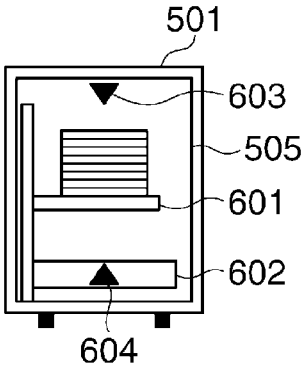
FIGS. 6A to 6F are diagrams useful in explaining a sequence of steps of a sheet bundle discharge process performed by a stacker apparatus appearing in FIG. 5.
Figure 6B:
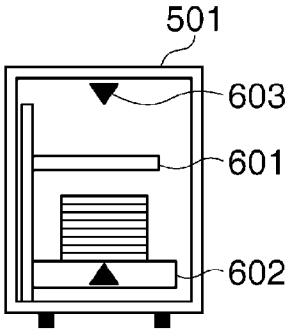

To cope with this, in the print-and-discharge process in FIG. 8, when it is determined, in a case where the sheet discharge setting information has been changed, that the printed sheets are stored in the stacker 505, the printed sheets stored in the stacker 505 are discharged from the stacker 505, in other words, the stacker apparatus 501. Note that here, the description is given by regarding the stacker 505 as substantially equivalent to the stacker apparatus 501, as illustrated in FIG. 6A.

Referring to FIG. 8, first, if the discharged sheets-setting count is included in the print data (YES to a step S801), the controller 201 acquires detection results from the sheet count sensor 603 and the sheet sensor 604, which are indicative of whether or not printed sheets are stacked on the lift table 601 and the eject table 602 (step S802). Then, the controller 201 determines whether or not the discharged sheets-setting count, included in the print data, has been changed by a user's operation of the UI section 210 (step S803).

If it is determined in the step S803 that the discharged sheets-setting count has been changed, the controller 201 determines, based on the detection results acquired in the step S802, whether or not printed sheets are stored in the stacker 505 (step S804). In the present embodiment, when the discharged sheets-setting count has been changed, before starting a printing operation to be performed on a plurality of sheets by the MFP 101 based on the setting-changed print data, the controller 201 checks whether or not printed sheets printed based on the print data based on which printing was performed (hereinafter referred to as the "preceding print data") before printing based on the setting-changed print data remain in the stacker 505. Note that in either of a case where the detection result from the sheet count sensor 603 indicates that the number of printed sheets stacked on the lift table 601 is equal to or larger than 1, and a case where the detection result from the sheet sensor 604 indicates detection of any printed sheet stacked on the eject table 602, it is determined that printed sheets are stored in the stacker 505. However, as a variation, a sheet sensor may be additionally provided at a location from which it can sense printed sheets stacked on the lift table 601, for detecting any printed sheet stacked on the lift table 601, and the detection result from this sheet sensor may be acquired in the step S802 for use in the determination in the step S804.

If it is determined in the step S804 that the printed sheets are stored in the stacker 505, the controller 201 judges that the printed sheets printed based on the preceding print data remain in the stacker 505, and determines whether or not the printed sheets stored in the stacker 505 can be discharged (step S805). In the present embodiment, if the printed sheets are stacked on only one of the lift table 601 and the eject table 602 as shown e.g. in FIG. 6B, the controller 201 judges that the printed sheets stored in the stacker 505 can be discharged. On the other hand, if the printed sheets are stacked on both of the lift table 601 and the eject table 602 as shown e.g. in FIG. 6D, the controller 201 judges that the printed sheets stored in the stacker 505 cannot be discharged.

Figure 6C:
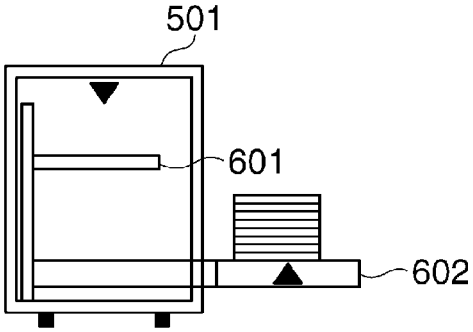
Figure 6D:
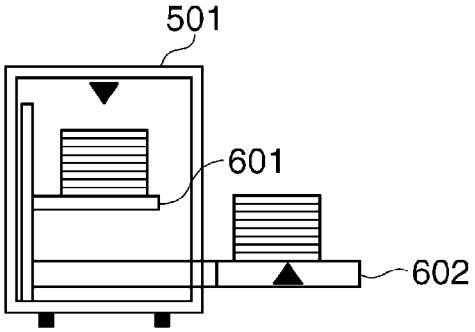
Figure 6E:
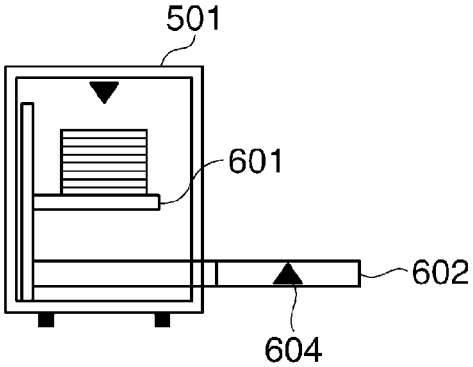
Figure 6F:
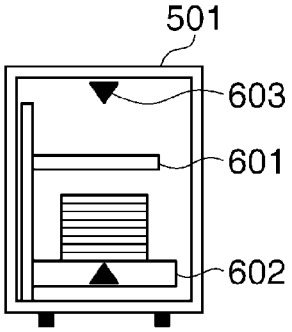

If it is determined in the step S805 that the printed sheets stored in the stacker 505 can be discharged, the controller 201 discharges all of the printed sheets stored in the stacker 505 as a sheet bundle, as shown in FIG. 6C (step S806). Then, the controller 201 performs a process for discharging sheets of a set sheet count, described hereinafter with reference to FIG. 9, to thereby perform printing on the plurality of sheets based on the acquired print data, and discharge the printed sheets as a sheet bundle formed by discharged sheets the number of which is equal to the discharged sheets-setting count (step S808), followed by terminating the present process.

If it is determined in the step S805 that the printed sheets stored in the stacker 505 cannot be discharged, the controller 201 causes the UI section 210 to display a message notifying that the printed sheets stored in the stacker 505 cannot be discharged (step S807), and returns to the step S805.

If it is determined in the step S803 that the discharged sheets-setting count has not been changed, or if it is determined in the step S804 that the printed sheets are not stored in the stacker 505, the controller 201 executes the step S808 without executing the steps S805 to S807, followed by terminating the present process.

FIG. 9 is a flowchart of the process for discharging sheets of a set sheet count, which is performed in the step S808 in FIG. 8.

Referring to FIG. 9, first, the controller 201 initializes a printed sheet count parameter P indicative of the number of printed sheets (step S901). By the initialization, the printed sheet count parameter P is set to 1. Note that P is an integer value satisfying P≥1. Then, the controller 201 initializes a stacked sheet count parameter X indicative of the number of printed sheets stacked in the stacker 505 (step S902). By the initialization, the stacked sheet count parameter X is set to 0. Note that X is an integer value satisfying X≥0. Then, the controller 201 determines whether or not the stacked sheet count parameter X is equal to a set sheet count parameter X_MAX corresponding to the discharged sheets-setting count included in the print data (step S903) (sheet count detection step).

If it is determined in the step S903 that the stacked sheet count parameter X is not equal to the set sheet count parameter X_MAX, the controller 201 determines whether or not the printed sheet count parameter P is not larger than a total printed sheet count parameter P_MAX corresponding to the number of sheets set by the print sheet count setting 304 included in the print data (step S904).

If it is determined in the step S904 that the printed sheet count parameter P is not larger than the total printed sheet count parameter P_MAX, the controller 201 judges that all of the sheets have not been printed, and acquires image data from the image data storage section 208 (step S905). Then, the controller 201 converts the acquired image data to video data, transmits the video data to the printer engine 209 (step S906), and causes the printer engine 209 to perform printing on a sheet fed from one of the sheet feed cassettes 502*a* to 502*d* based on the video data (step 907). Then, the controller 201 causes the printed sheet to be conveyed to the stacker 505 of the stacker apparatus 501 (step S908), adds 1 to the printed sheet count parameter P (step S909), adds 1 to the stacked sheet count parameter X (step S910), and returns to the step S903.

If it is determined in the step S903 that the stacked sheet count parameter X is equal to the set sheet count parameter X_MAX, the controller 201, which judges that the printed sheets of the discharged sheets-setting count have been stored in the stacker 505, discharges all of the printed sheets stored in the stacker 505 as a sheet bundle formed by the printed sheets of the discharged sheets-setting count (step S911) (sheet discharge control step), and returns to the step S902.

If it is determined in the step S904 that the printed sheet count parameter P is larger than the total printed sheet count parameter P_MAX, the controller 201 judges that all of the sheets have been printed, and terminates the present process.

According to the above-described processes in FIGS. 8 and 9, if it is determined, in a case where the sheet discharge setting information has been changed, that printed sheets remain in the stacker 505, the printed sheets remaining in the stacker 505 are discharged from the stacker 505, and then, the process for discharging sheets of a set sheet count is performed using the setting-changed print data. This makes it possible to prevent printed sheets printed and stored based on the setting-changed print data and printed sheets printed and stored based on the preceding print data from being mixed in the stacker 505, whereby it is possible to acquire the printed sheets as a sheet bundle formed by the printed sheets of the discharged sheets-setting count.

Figure 4:
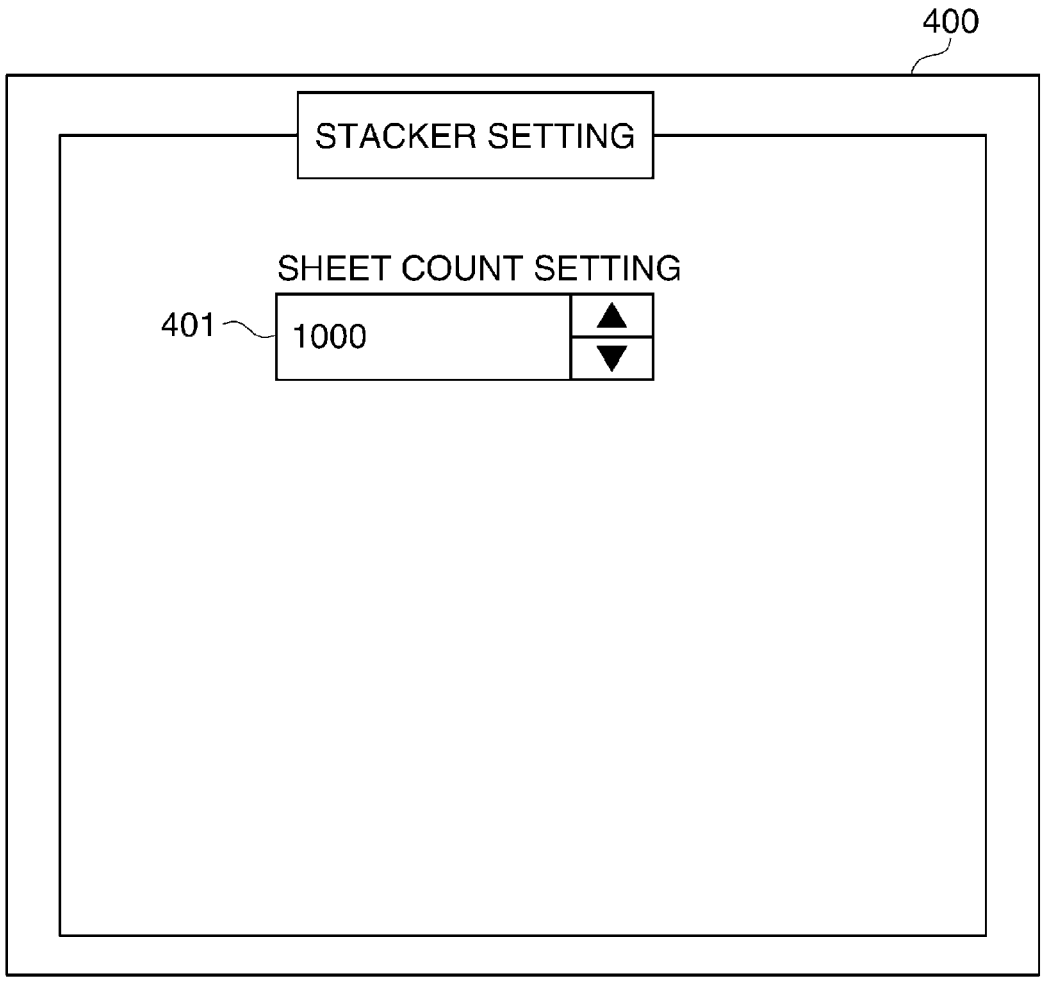
FIG. 4 is a diagram useful in explaining a sheet discharge-setting menu displayed on the client PC.

Although in the above-described processes in FIGS. 7 to 9, in the case of discharging printed sheets from the stacker apparatus 501 as a sheet bundle, the number of sheets forming the sheet bundle is set on the sheet discharge-setting menu 400 shown in FIG. 4, this is not limitative, but in a case where each page is printed for a printed outcome formed by a plurality of pages, the number of copies of the printed outcome may be set.

In the print-and-discharge process described with reference to FIG. 8, if a user who has instructed execution of a print job based on the setting-changed print data is the same user who has instructed execution of a print job based on the preceding print data, there is a case where the printed sheets stored in the stacker 505 are not necessarily required to be discharged from the stacker 505, as described hereinafter with reference to FIG. 10.

Figure 10:
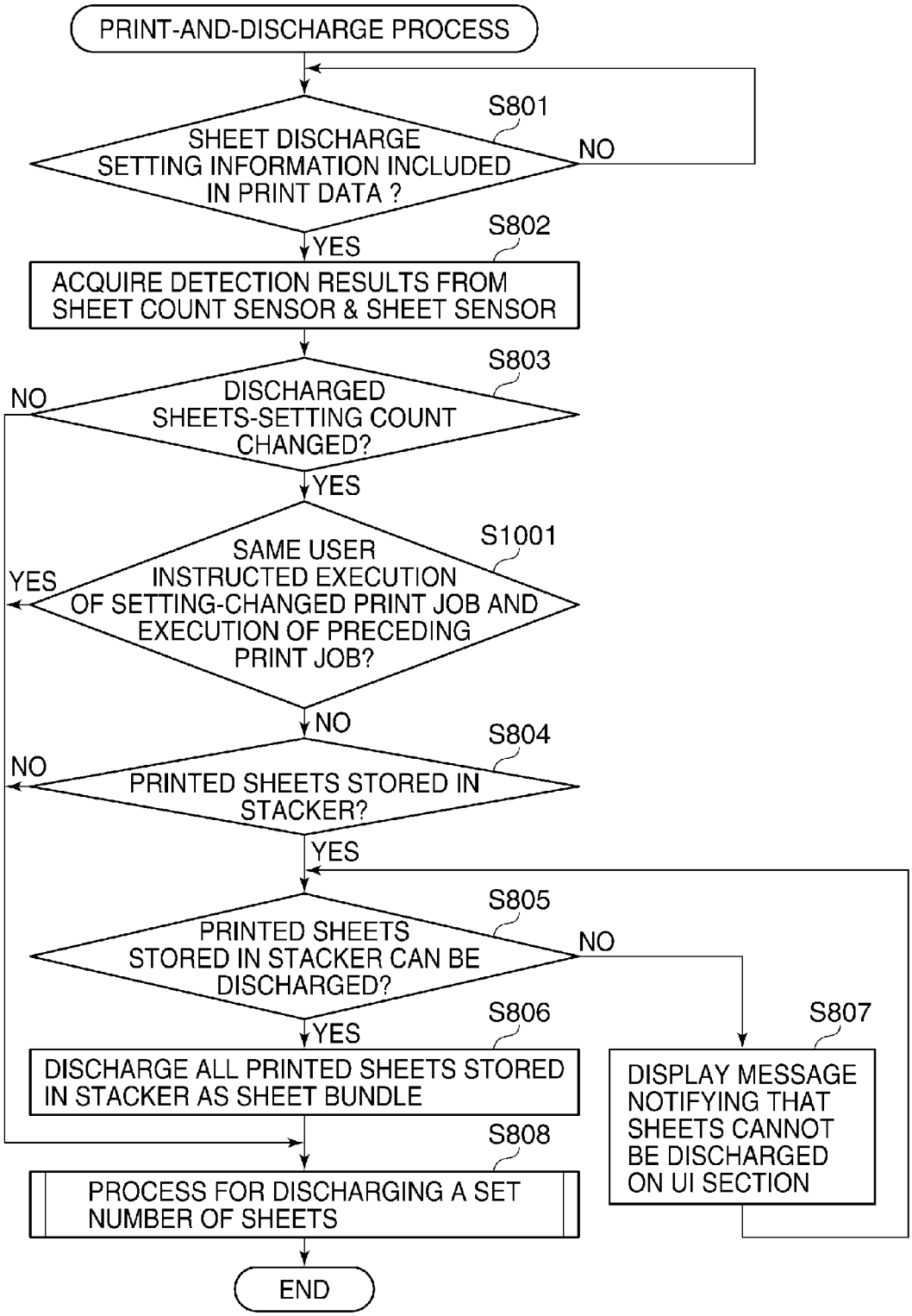
FIG. 10 is a flowchart of a variation of the print-and-discharge process in FIG. 8.

FIG. 10 is a flowchart of a variation of the print-and-discharge process in FIG. 8.

According to the print-and-discharge process in FIG. 8, in a case, for example, where a print job is to be performed for 1000 sheets based on print data set such that printed sheets are to be discharged from the stacker 505 as sheet bundles each formed by 300 sheets, eventually, 100 printed sheets remain in the stacker 505. However, if the discharged sheets-setting count included in the print data is changed, the remaining 100 printed sheets are discharged from the stacker 505, and hence the 100 printed sheets remaining in the stacker 505 cannot be made use of when a print job is executed based on the setting-changed print data which is changed only in the discharged sheets-setting count.

To cope with this, in the variation in FIG. 10, in a case where a user who has instructed execution of a print job based on the setting-changed print data is the same user who has instructed execution of a print job based on the preceding print data, if the number of printed sheets which have been stored in the stacker 505 by executing the print job based on the preceding print data and have not been discharged is smaller than the discharged sheets-setting count included in the setting-changed print data, the printed sheets stored in the stacker 505 are inhibited from being discharged from the stacker 505.

The variation in FIG. 10 is performed by the controller 201 that executes the various control programs stored in the storage section 202.

Referring to FIG. 10, first, the controller 201 executes the same steps as the steps S801 to S803 in FIG. 8.

If it is determined in the step S803 that the discharged sheets-setting count has been changed, the controller 201 determines, based on the user identification information included in the print data, whether or not a user who has instructed execution of the print job based on the setting-changed print data (hereinafter referred to as the "setting-changed print job") is the same user who has instructed execution of the print job based on the preceding print data (hereinafter referred to as the "preceding print job") (step S1001).

If it is determined in the step S1001 that the user who has instructed execution of the setting-changed print job is the same user who has instructed execution of the preceding print job, the controller 201 proceeds to the process for discharging sheets of a set sheet count in the step S808. Here, in the case where the user who has instructed execution of the setting-changed print job is the same user who has instructed execution of the preceding print job, it can be considered that although the sheet discharge setting information is different, the contents to be printed by execution of the print jobs based on the respective setting-changed print data and preceding print data are the same, and hence the printed sheets stored in the stacker 505 by executing the preceding print job are inhibited from being discharged. That is, in the present embodiment, the printed sheets stored in the stacker 505 by executing the preceding print job are made use of as part of the printed sheets which are to be stored in the stacker 505 by executing the setting-changed print job.

If it is determined in the step S1001 that the user who has instructed execution of the setting-changed print job is not the same user who has instructed execution of the preceding print job, the controller 201 judges that the printed sheets stored in the stacker 505 by executing the preceding print job cannot be used as part of the printed sheets which are to be stored in the stacker 505 by executing the setting-changed print job, and hence proceeds to the step S804.

If it is determined in the step S803 that the discharged sheets-setting count has not been changed, the controller 201 executes the step S808, followed by terminating the present process.

According to the variation of the print-and-discharge process described with reference to FIG. 10, when the user who has instructed execution of the setting-changed print job is the same user who has instructed execution of the preceding print job, if the number of printed sheets which have been stored in the stacker 505 by executing the preceding print job and have not been discharged is smaller than the discharged sheets-setting count included in the setting-changed print data, the printed sheets stored in the stacker 505 are inhibited from being discharged from the stacker 505. This makes it possible to make use of the printed sheets which have not been discharged, as part of the printed sheets to be stored in the stacker 505 by executing the setting-changed print job. As a result, it is possible to reduce the execution time of the setting-changed print job.

Further, according to the variation of the print-and-discharge process described with reference to FIG. 10, a user who has instructed execution of a print job based on each print data is identified based on the user identification information included in the print data. This makes it possible to easily identify a user who has instructed execution of a print job based on each print data without increasing the information associated with the user more than necessary when performing the print job based on the print data.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-080940 filed Apr. 10, 2015, which is hereby incorporated by reference herein in its entirety.

What is claimed is:

1. A method of controlling discharge of printed sheets, which is applied in performing printing, based on a print job including print processing on sheets of a desired sheet count set by a user, on a plurality of sheets, by a printing apparatus, conveying the plurality of sheets on which the printing has been performed from the printing apparatus to a sheet discharge unit, and storing the printed sheets in the sheet discharge unit, the method comprising:

determining whether or not printed sheets are stored in the sheet discharge unit;

detecting the number of printed sheets stored in the sheet discharge unit; and discharging the stored printed sheets from the sheet discharge unit as a sheet bundle when the number of printed sheets stored in the sheet discharge unit is equal to the desired sheet count, wherein said discharging includes discharging the printed sheets stored in the sheet discharge unit from the sheet discharge unit, when it is determined, in a case where the set desired sheet count has been changed, that the printed sheets are stored in the sheet discharge unit.

2. The method according to claim 1, wherein in a case where at least two print jobs are performed, when the same user has instructed execution of each print job, said discharging includes not discharging the printed sheets stored in the sheet discharge unit from the sheet discharge unit, on condition that the number of printed sheets which have been stored in the sheet discharge unit by executing one of the print jobs and have not been discharged is smaller than the desired sheet count set for another of the print jobs.

3. The method according to claim 2, further comprising identifying a user who has instructed execution of each print job, and wherein each print job includes information for identifying a user who has set the desired sheet count, and wherein said identifying includes identifying a user who has instructed execution of each print job based on the information for identifying a user who has set the desired sheet count, which is included in each print job.

4. A sheet discharge control apparatus that performs control of discharge of printed sheets from a sheet discharge unit, in performing printing, based on a print job including print processing on sheets of a desired sheet count set by a user, on a plurality of sheets, by a printing apparatus, conveying the plurality of sheets on which the printing has been performed from the printing apparatus to the sheet discharge unit, and storing the printed sheets in the sheet discharge unit, the sheet discharge control apparatus comprising:

a determination unit configured to determine whether or not printed sheets are stored in the sheet discharge unit;

a sheet count detection unit configured to detect the number of printed sheets stored in the sheet discharge unit; and a sheet discharge control unit configured to discharge the stored printed sheets from the sheet discharge unit as a sheet bundle when the number of printed sheets stored in the sheet discharge unit is equal to the desired sheet count, wherein said sheet discharge control unit discharges the printed sheets stored in the sheet discharge unit from the sheet discharge unit, when it is determined, in a case where the set desired sheet count has been changed, that the printed sheets are stored in the sheet discharge unit.

5. The sheet discharge control apparatus according to claim 4, wherein in a case where at least two print jobs are performed, when the same user has instructed execution of each print job, said discharge control unit does not discharge the printed sheets stored in the sheet discharge unit from the sheet discharge unit, on condition that the number of printed sheets which have been stored in the sheet discharge unit by executing one of the print jobs and have not been discharged is smaller than the desired sheet count set for another of the print jobs.

6. The sheet discharge control apparatus according to claim 5, further comprising a user identification unit configured to identify a user who has instructed execution of each print job, and wherein each print job includes information for identifying a user who has set the desired sheet count, and wherein said user identification unit identifies a user who has instructed execution of each print job based on the information for identifying a user who has set the desired sheet count, which is included in each print job.

7. A non-transitory computer-readable storage medium storing a computer-executable control program for causing a computer to execute a method of controlling discharge of printed sheets, which is applied in performing printing, based on a print job including print processing on sheets of a desired sheet count set by a user, on a plurality of sheets, by a printing apparatus, conveying the plurality of sheets on which the printing has been performed from the printing apparatus to a sheet discharge unit, and storing the printed sheets in the sheet discharge unit, wherein the method comprises:

determining whether or not printed sheets are stored in the sheet discharge unit;

detecting the number of printed sheets stored in the sheet discharge unit; and discharging the stored printed sheets from the sheet discharge unit as a sheet bundle when the number of printed sheets stored in the sheet discharge unit is equal to the desired sheet count, wherein said discharging includes discharging the printed sheets stored in the sheet discharge unit from the sheet discharge unit, when it is determined, in a case where the set desired sheet count has been changed, that the printed sheets are stored in the sheet discharge unit.

* * * * *